US012454820B2

(12) United States Patent
Probyn et al.

(10) Patent No.: US 12,454,820 B2
(45) Date of Patent: Oct. 28, 2025

(54) URINAL UNIT

(71) Applicant: PEEQUAL LTD., Birmingham (GB)

(72) Inventors: Amber Probyn, Bristol (GB); Hazel McShane, Bristol (GB)

(73) Assignee: Peequal Ltd., West Midland (GB)

( * ) Notice: Subject to any disclaimer, the term of this patent is extended or adjusted under 35 U.S.C. 154(b) by 247 days.

(21) Appl. No.: 18/556,546

(22) PCT Filed: Apr. 7, 2022

(86) PCT No.: PCT/GB2022/050882
§ 371 (c)(1),
(2) Date: Oct. 20, 2023

(87) PCT Pub. No.: WO2022/223946
PCT Pub. Date: Oct. 27, 2022

(65) Prior Publication Data

US 2024/0191487 A1 Jun. 13, 2024

(30) Foreign Application Priority Data

Apr. 22, 2021 (GB) ..... 2105763
Jul. 28, 2021 (GB) ..... 2110852

(51) Int. Cl.
*E03D 13/00* (2006.01)
*A47K 11/02* (2006.01)

(52) U.S. Cl.
CPC ..... *E03D 13/00* (2013.01); *A47K 11/02* (2013.01)

(58) Field of Classification Search
CPC ..... E03D 13/00; A47K 11/02; E04H 1/1216
See application file for complete search history.

(56) References Cited

U.S. PATENT DOCUMENTS 5,426,900 A * 6/1995 Springer ..... E06B 3/90 52/236.1
2008/0307714 A1 12/2008 Knoop
2010/0058518 A1* 3/2010 Bourgeois ..... E04H 1/1216 4/144.1

FOREIGN PATENT DOCUMENTS

CN 112502489 A 3/2021
JP H0768718 B2 7/1995
WO 2019137592 A1 7/2019

OTHER PUBLICATIONS

Pollee system from PeeBetter in Denmark, http://peebetter.dk/category/pollee/, accessed Oct. 20, 2023.

* cited by examiner

*Primary Examiner* — Janie M Loeppke
(74) *Attorney, Agent, or Firm* — Saxton & Stump, LLC

(57) ABSTRACT

A urinal unit formed from a wedge-shaped base, side walls, outer walls, an internal wall, and a barrier wall. The base has an inner angle, sides, and an outer edge. The side walls extend along each side of the base from the inner angle to the outer edge. The outer wall extends from the outer end of each side wall part-way along the outer edge of the base towards the other side wall so that a space is formed between adjacent ends of the outer walls. The internal wall extends from the inner angle between the side walls part-way to the outer edge. The barrier wall is located at the outer end of the inner wall so as to extend perpendicularly to the internal wall part way towards the side walls. A urinal pedestal is located between each side wall and the internal wall and positioned so that a user faces the outer edge. The lengths of the outer walls and the barrier wall are such that there is no direct line-of-sight through the space between the outer walls to the pedestals. A urinal installation can be formed from a series of urinal units arranged so that the side wall of one unit is positioned adjacent the side wall of another unit.

29 Claims, 8 Drawing Sheets

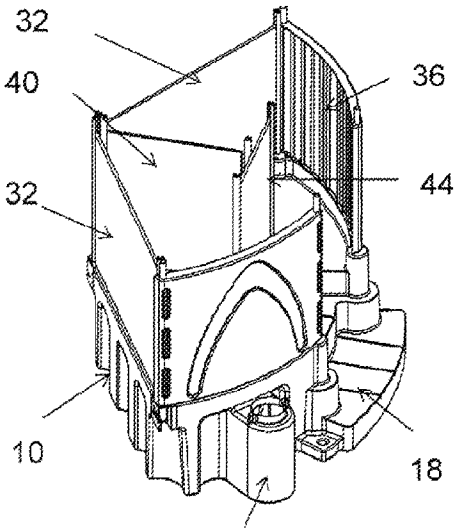
Fig. 3
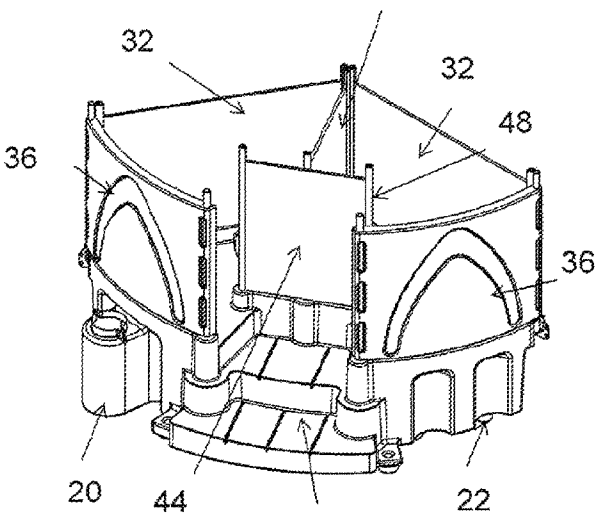
Fig. 2
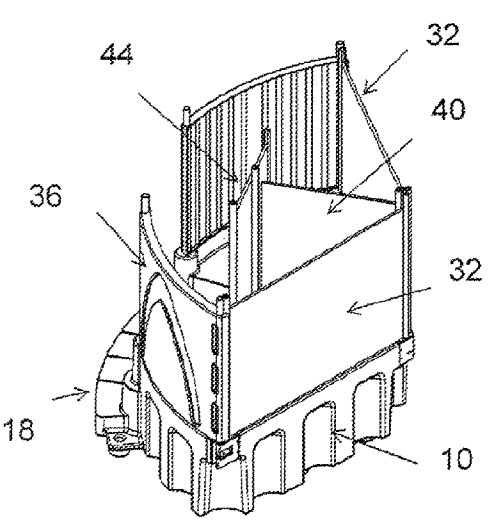
Fig. 1
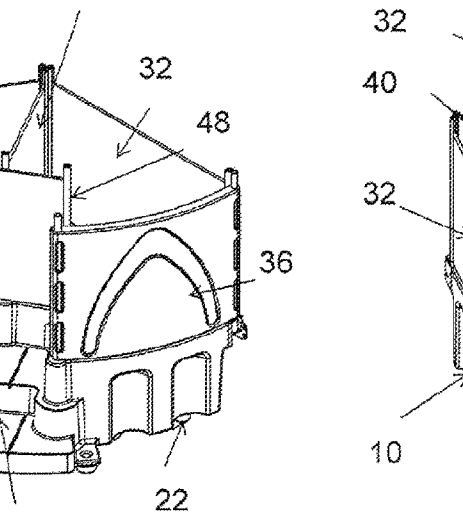
Fig. 5
Fig. 4

URINAL UNIT

This invention relates to urinals. In particular, the invention relates to a modular urinal structure that can be used in temporary installations and is suitable for use by women.

Providing temporary toilet facilities that are safe, hygienic, and effective at outdoor events such as festivals is a long-standing problem. There have been a number of solutions for providing urinals for male use. However, to date, there are no corresponding convenient urinal facilities for female use. The means that women are forced to use traditional temporary enclosed toilets and so are often underserved and need to queue for longer. The cost of providing traditional temporary toilets is relatively high and these are not optimised for use as urinals. They are more difficult to keep clean and needed a user to touch various parts to use them.

There have been some previous proposals to provide urinals suitable for use by women. WO 2019/137592 describes a portable and stackable unit. Another proposal is the Pollee system from PeeBetter in Denmark (http://peebetter.dk/category/pollee/). These systems are multi-stall units and cannot be installed together for effective use of space.

A first aspect of the invention provides a urinal unit, comprising:

- a wedge-shaped base including first and second sides extending from an apex defining an inner angle to an outer edge;
- a first side wall extending along the first side of the base from the apex to the outer edge;
- an outer wall extending from an outer end of the first side wall part-way along the outer edge of the base toward the second side;
- an internal barrier wall extending perpendicularly to the second side part way across the base towards the first side; and
- a urinal pedestal located between the internal barrier wall and the inner angle;

wherein the lengths of the outer wall and the internal barrier wall are such that they overlap and there is no direct line-of-sight from the outer edge to the pedestal.

The base can have a series of ridges defining the positions of the side wall, outer wall, and internal barrier wall, and mounting holes can be provided on the ridges to receive mounting rods at ends of the outer wall and the internal barrier wall.

The first and second sides of the base can comprise cut-outs to receive mounting rods at ends of the first side wall.

The first side wall, the outer wall, and the internal barrier wall can all be removably mounted on the base; and the pedestal can be removably mounted on the base.

The urinal unit can further comprise a sump in the base, wherein the pedestal drains into the sump, and wherein the sump has an access drain located at the outer edge of the base.

A series of steps can be defined in the base extending from the outer edge towards the internal barrier wall.

In one embodiment, the inner angle is about 60°.

The urinal unit can further comprise a second side wall extending along the second side of the base from the apex to the outer edge. In some embodiments, only a first side wall is provided.

A second aspect of the invention provides a urinal installation, comprising a series of urinal units according to the first aspect arranged so that the first side of one unit is positioned adjacent the second side of another unit.

In one embodiment, the units are arranged such that the apex of each unit is centred on a common point. For example, six units can be arranged in a circular arrangement.

In another embodiment, adjacent urinal units are arranged so that the outer end of the first side of one unit is positioned adjacent the apex end of the second side of the other unit, such that the outer wall of one unit faces in the opposite direction to the outer wall of the adjacent unit.

Where the urinal units only have a first wall on the first side, the installation can comprise a series of urinal units arranged so that the first side of one unit is positioned adjacent the second side of another unit, and the first side wall of the one unit provides a second side wall for the other unit.

A third aspect of the invention provides a urinal unit, comprising:

- a wedge-shaped base having an inner angle (i.e. an apex), sides, and an outer edge;
- a side wall extending along each side of the base from the inner angle to the outer edge;
- an outer wall extending from an outer end of each side wall part-way along the outer edge of the base toward the other side wall so that a space is formed between adjacent ends of the outer walls;
- an internal wall extending from the inner angle between the side walls part-way to the outer edge;
- an internal barrier wall located at an outer end of the inner wall so as to extend perpendicularly to the internal wall part way towards the side walls; and
- a urinal pedestal located between each side wall and the internal wall and positioned so that a user faces the outer edge;

wherein the lengths of the outer walls and the internal wall are such that there is no direct line-of-sight through the space between the outer walls to the pedestals.

The base can have a series of ridges defining the positions of the side walls, outer walls, internal wall, and barrier wall, and mounting holes can be provided on the ridges to receive mounting rods at the ends of the respective side walls, outer walls, internal wall, and barrier wall.

The mounting rods can comprise elongate rods with axial slots into which edges of wall structures are inserted. In other embodiments of the invention, the mounting rods form part of the wall structure, such as forming part of an extension of a frame, or formed integrally with the wall.

The side walls, outer walls, internal wall, and barrier wall can all be removably mounted on the base; and the pedestals can be removably mounted on the base.

The urinal unit can further comprise a sump in the base, wherein each pedestal drains into the sump, and wherein the sump has an access drain located at the outer edge of the base.

A series of steps can be defined in the base in the space between the ends of the outer walls.

In one embodiment, the inner angle is about 120°.

A fourth aspect of the invention provides a urinal installation, comprising a series of urinal units according to the third aspect arranged so that the side wall of one unit is positioned adjacent the side wall of another unit.

The units can be arranged such that the inner angles are centred on a common point, for example three units arranged in a circular arrangement.

In one embodiment, adjacent urinal units are arranged so that the inner end and outer end of the side wall of one unit are positioned adjacent the outer end and the inner end respectively of the side wall of the other unit, such that the space between the outer walls of one unit faces in the opposite direction to the space between the outer walls of the adjacent unit.

The units and installations have a number of advantages. By positioning the pedestal in the angle, there is sufficient space for entrance and exit without the need for doors or other contact or touch points. Also, positioning the pedestal in the angle facing outwards means that the angled walls can provide a user with support.

The use of a wedge-shaped base means that the units can be positioned next to each other in different ways so as to make good use of the space available and avoid overcrowding when queueing.

By making the walls removable, the units can be disassembled and the bases and walls stored efficiently.

Other advantages are described below.

Embodiments of the invention are shown in the accompanying drawings:

FIGS. 1, 2, 3, 4, and 5 show views of one fully assembled urinal unit.

FIGS. 6 and 7 show views of the unit of FIGS. 1-5 in a partially-assembled form.

FIGS. 8, 9, and 10 show views of a first installation formed using the unit of FIGS. 1-5.

Figure 7:
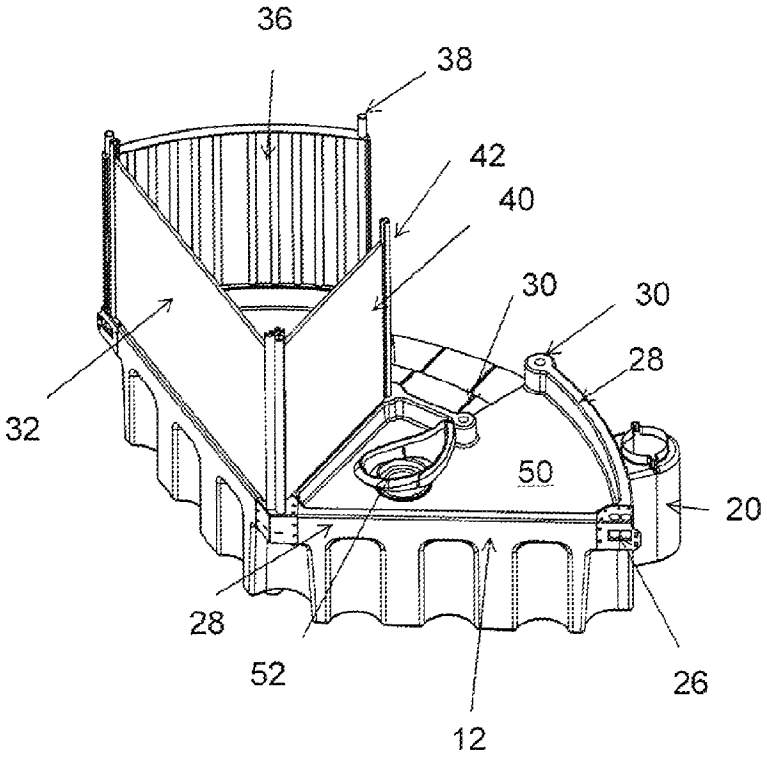
Figure 6:
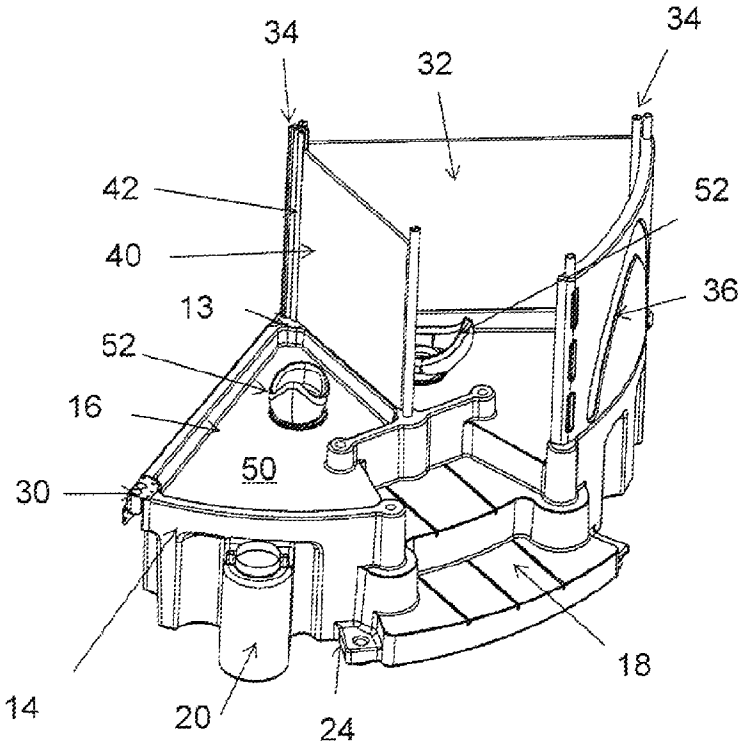

The unit shown in the drawings is formed from moulded structures that can be easily assembled and disassembled and arranged in different configurations according to requirements.

FIGS. 1-7 show various view of a basic urinal unit of the invention.

The unit comprises a wedge-shaped base 10 that defines a sump or tank that can be placed on the ground surface. The base 10 has straight sides 12 that meet to define an apex with an inner angle 13. The outer side 14 (i.e. the side facing the inner angle) is curved so the base is in the form of a sector. In other embodiments, the outer side can be straight.

The upper surface 16 of the base 10 is raised above ground level and a series of steps 18 are defined in the middle of the outer side for access from ground level. An access drain 20 is provided at the outer side 14 to allow liquid to be drained form the sump.

The base 10 is also provided with feet 22 to aid positioning on the ground surface, lifting eyes 24, and brackets 26 for connection to other units. Manual lifting points can also be provided.

The upper surface 16 of the base 10 has a series of ridges 28 defining mounting points for wall structures. Each ridge 28 has a hole 30 at each end for receiving mounting rods for the wall structures as described in more detail below.

The wall structures include side walls 32 that are mounted along the sides 12 of the base 10 and extend from the inner angle 13 to the outer edge 14. The side wall structures 32 are flat panels that slot into mounting rods 34 fitted into holes 30 in the base 10.

Outer walls 36 are located at the outer ends of the side walls 32. The outer walls 36 have a form that follows the curved shape of the outer side 14 of the base 10. If the outer side 14 of the base 10 is straight, the outer walls 36 can be flat. The outer wall structures 36 have integral locating rods 38 that fit into respective holes 30 in the ridge 28 on the base 10. If the outer walls 36 are flat, slotted mounting rods similar to those of the side wall 32 can be used. The outer walls 36 extend from the ends of the side walls 32 up to the steps 18 in the base unit 10, the space between the walls 36 defining an entrance opening.

An internal wall 40 extends from the inner angle 13 to bisect the wedge into two substantially equal halves. The internal wall 40 only extends part way across the upper surface 16, terminating at the steps 18. The internal wall 40 is mounted on slotted mounting rods 42 in the same way as the side walls 32. A barrier wall 44 is located at the outer end of the internal wall 40 in a perpendicular or transverse arrangement so as to extend either side of the internal wall 40. Again, this barrier wall 44 is located on slotted mounting rods 48. The barrier wall 44 is slightly wider than the steps 18.

The space between the internal wall and a side wall defines a cubicle 50. A urinal pedestal 52 is located in the angle of the cubicle 50 and positioned to face the outer surface 14. The pedestal 52 drains into the sump and is fitted with a filter to stop solid material passing into the sump. The pedestal 52 can be removable.

The arrangement of outer wall 36 and barrier wall 44 structures means that there is no direct line-of-sight through the entrance opening to the pedestal 52 and so provides privacy for the user while maintaining space for easy access. The wall structures 32, 36, 40, 44 are high enough to shield a user from all sides when using the urinal. The wedge shape and outward facing pedestal 52 means that the walls 32, 40 can provide support as well as screening. The unit is open topped.

Figure 9:
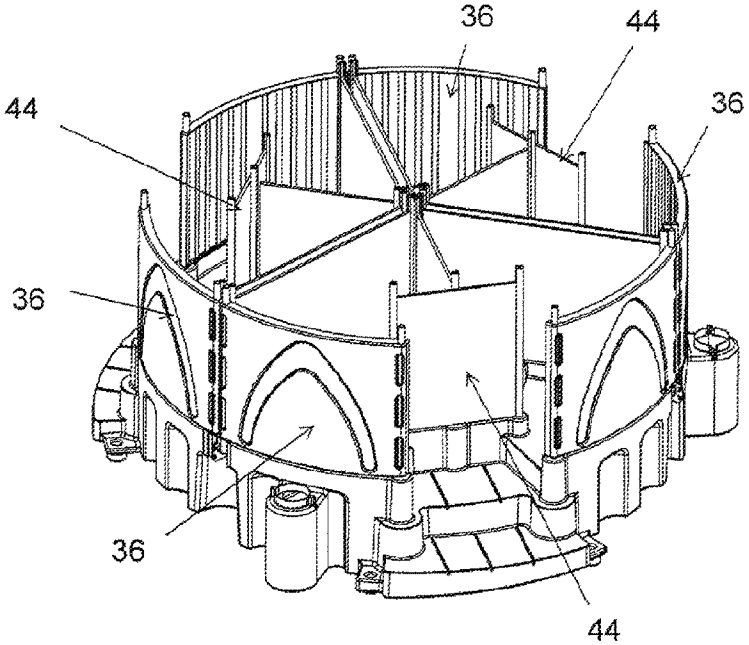
Figure 8:
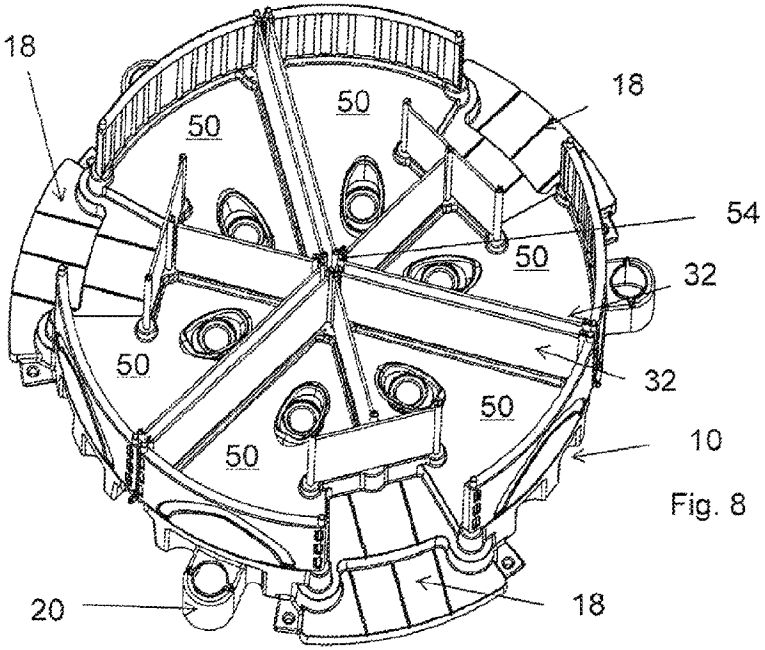
Figure 10:
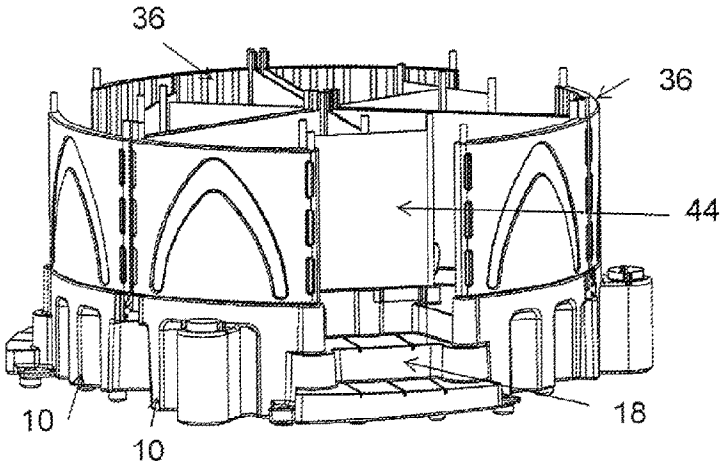

Multiple units can be positioned together in a single installation for convenience. FIGS. 8-10 show a first installation. The bases 10 are positioned so that the side walls 32 are adjacent and aligned with each other. The angle of the wedge-shaped base is no more than 120°. This means that three units can be arranged in a circular arrangement with the inner angles on a common point 54. This arrangement has the advantage that the entrances are spaced apart from each other allowing users to maintain distance when entering or leaving the units.

Figures 11, 12:
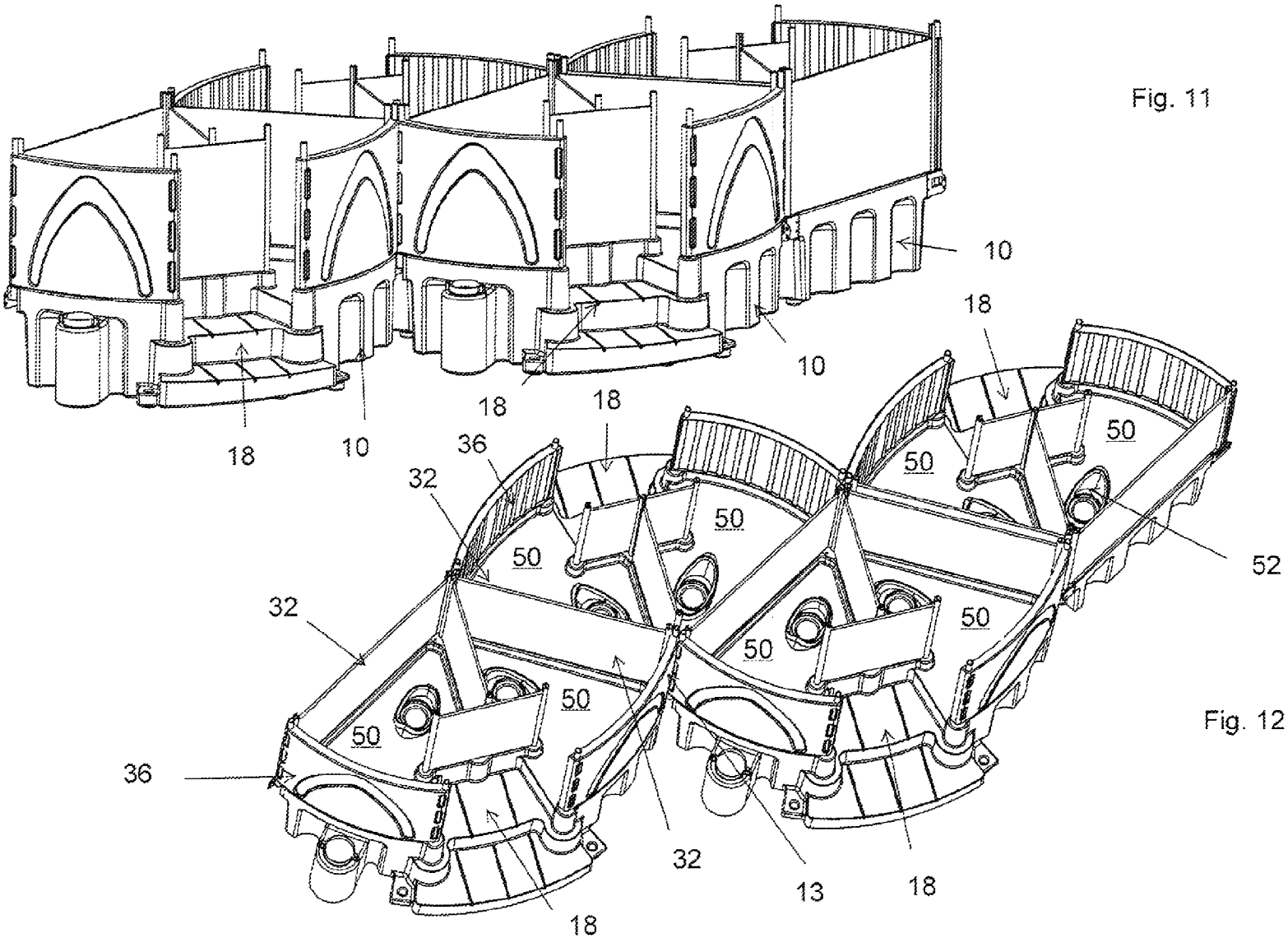
FIGS. 11 and 12 show views of a second installation formed using the unit of FIGS. 1-5.

FIGS. 11 and 12 show a second installation in which the units 10 are alternated so that the entrances are on opposite sides (i.e. the angle 13 of one unit is positioned adjacent the outer end of the side wall 32 of the adjacent unit. The installation in FIGS. 11 and 12 shows a four-unit installation. The number of units can be selected according to requirements and space available.

In both forms of installation, the units can be secured to each other using the brackets 26 for stability.

When not in use, the walls structures 32, 36, 40, 44 and pedestals 52 can be removed, and the base units 10 stacked. The ability to remove the wall structures 32, 36, 40, 44 and pedestals 52 means that damage can easily be rectified without losing the use of a whole unit. Also, the various components can be cleaned and sanitized more easily.

Figures 13, 14, 15:
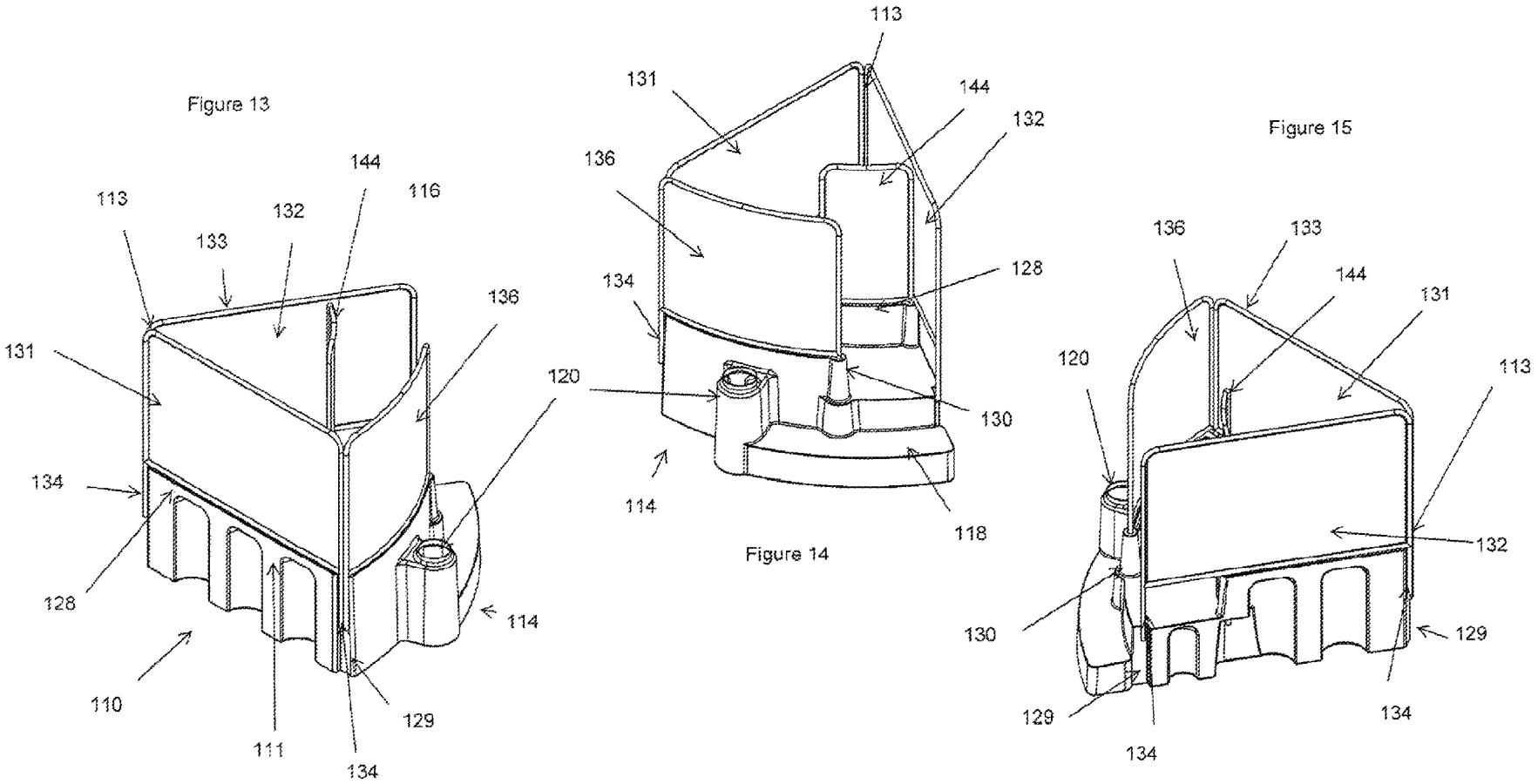
FIGS. 13-15 show views of a different fully assembled urinal unit.

FIGS. 13-15 show a urinal unit according to a different embodiment.

The unit comprises a wedge-shaped base 110 that defines a sump or tank that can be placed on the ground surface. The base 110 has straight sides 111, 112 that meet to define an apex with inner angle 113. The outer side 114 (i.e. the side facing the inner angle) is curved so the base is in the form of a sector. In other embodiments, the outer side can be straight.

The upper surface 116 of the base 10 is raised above ground level and a series of steps 118 are defined to one side of the outer side 114 for access from ground level. An access drain 120 is provided at the outer side 114 to allow liquid to be drained form the sump.

The upper surface 116 of the base 110 has a series of ridges 128 defining mounting points for wall structures. Each ridge 128 has a cut out 129 or hole 130 at each end for receiving mounting rods for the wall structures as described in more detail below.

The wall structures include first and second side walls 131,132 that are mounted along the sides 111, 112 of the base 110 and extend from the apex 113 to the outer edge 114. The side wall structures 131, 132 are flat panels with frames 133 that extend down to form mounting rods 134 that can be fitted into the cut outs 129 or holes 130 in the base 110.

An outer wall 136 is located at the outer end of the first side walls 131. The outer wall 136 has a form that follows the curved shape of the outer side 114 of the base 110. If the outer side 114 of the base 110 is straight, the outer wall 136 can be flat. The outer wall structure 136 has locating rods 138 that fit into a respective cut out 129 or hole 130 in the ridge 128 on the base 110. The outer wall 136 extends from the end of the first side wall 131 up to the steps 118 in the base unit 110. The space between the end of the outer walls 136 and the end of the second side wall 132 defines an entrance opening.

A barrier wall 144 is located part way along the second side wall 132 at the top of the steps 118 in a perpendicular or transverse arrangement so as to extend part way across the base 116. The barrier wall 144 has mounting rods that are fitted into holes 130. The end of the outer wall 136 overlaps the end of the barrier wall 144.

The space between the side walls 131, 132 defines a cubicle 150. A urinal pedestal is located in the angle of the cubicle 150 and positioned to face the outer surface 114. The pedestal drains into the sump and is fitted with a filter to stop solid material passing into the sump. The pedestal can be removable.

The arrangement of outer wall 136 and barrier wall 144 means that there is no direct line-of-sight through the entrance opening to the pedestal and so provides privacy for the user while maintaining space for easy access. The wall structures 131 132, 136, and 144 are high enough to shield a user from all sides when using the urinal. The wedge shape and outward facing pedestal means that the side walls 131 132 can provide support as well as screening. The unit is open topped.

Figure 16:
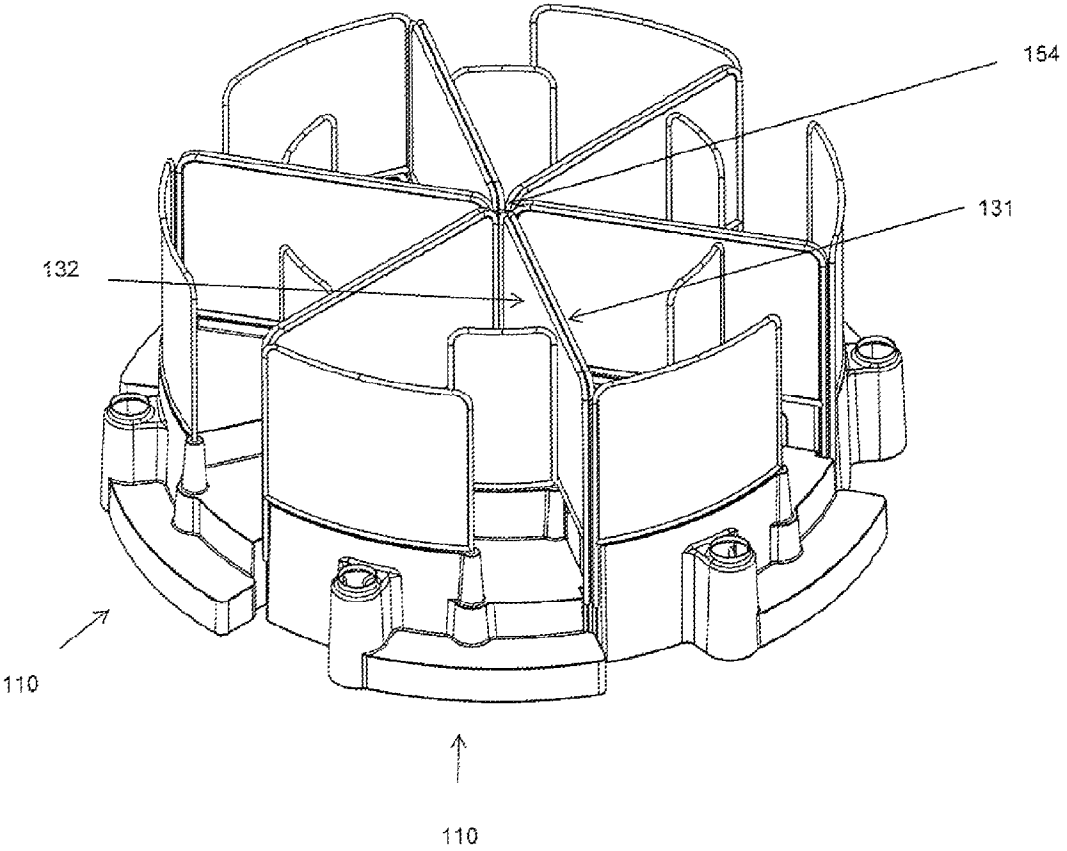
FIG. 16 shows a view of a third installation formed using the unit of FIGS. 13-15.

Multiple units can be positioned together in a single installation for convenience. FIG. 16 shows a third installation. The bases 110 are positioned so that the side walls 131, 132 are adjacent and aligned with each other. The angle of the wedge-shaped base is no more than 60°. This means that six units can be arranged in a circular arrangement with the apexes on a common point 154. This arrangement has the advantage that the entrances are spaced apart from each other allowing users to maintain distance when entering or leaving the units.

Figure 17:
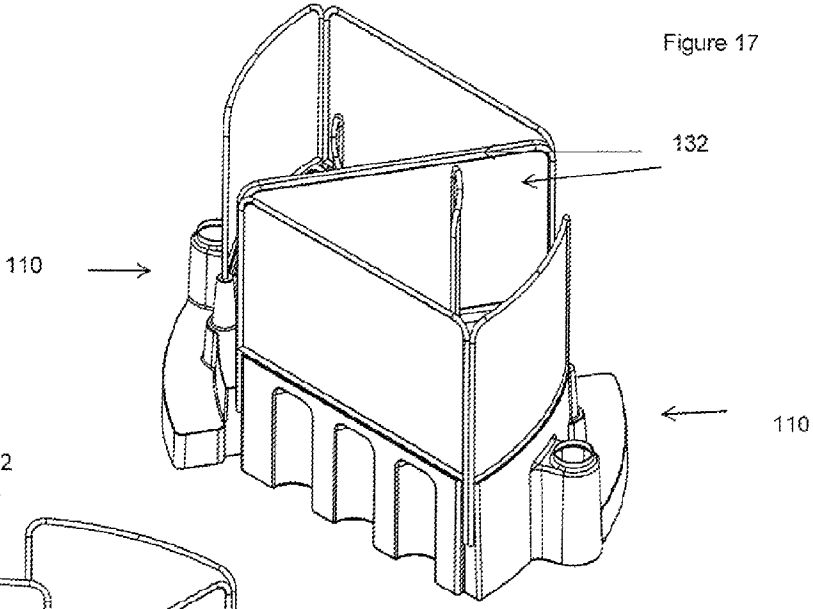
FIGS. 17 and 18 show views of a fourth installation formed using the unit of FIGS. 13-15.
Figure 18:
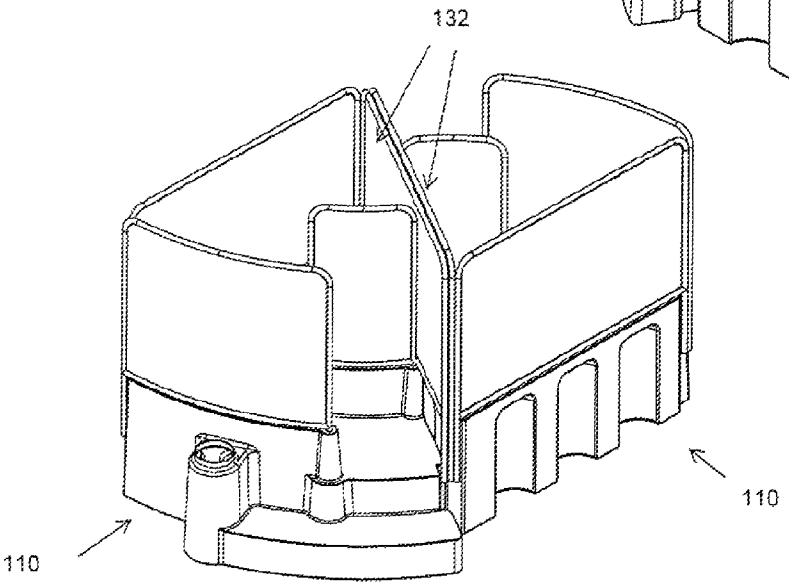

FIGS. 17 and 18 show a fourth installation in which the units 110 are alternated so that the entrances are on opposite sides (i.e. the apex of one unit is positioned adjacent the outer end of the second side wall 132 of the adjacent unit. The installation in FIGS. 17 and 18 shows a two-unit installation. The number of units can be selected according to requirements and space available.

Figure 19:
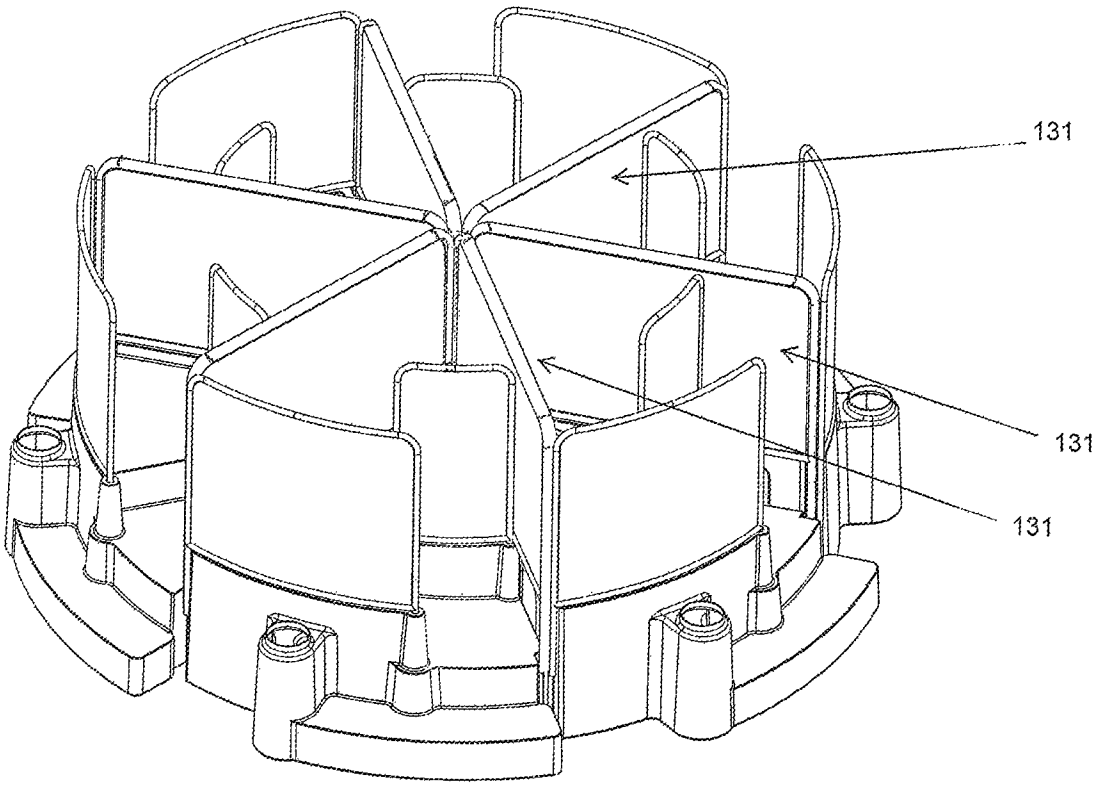
FIG. 19 shows a fifth installation formed using the unit of FIGS. 13-15.

FIG. 19 shows a fifth installation in which six units are arranged in a circular array similar to that of FIG. 16. However, in this case, the second side wall 132 of each unit is omitted, the first side wall 131 of the adjacent unit acting as the second side wall for its neighbour. This means that fewer side walls are needed for a given installation. The installation of FIGS. 17 and 18 can similarly be constructed omitting one side wall element from each unit. In this case it is alternate first and second walls that may be omitted to ensure that there is at least one wall between each cubicle.

Various other changes can be made within the scope of the invention.

The invention claimed is:

1. A urinal unit, comprising:

a wedge-shaped base including first and second sides extending from an apex defining an inner angle to an outer edge;

a first side wall extending along the first side of the base from the apex to the outer edge;

an outer wall extending from an outer end of the first side wall part-way along the outer edge of the base toward the second side;

an internal barrier wall extending perpendicularly to the second side part way across the base towards the first side; and a urinal pedestal located between the internal barrier wall and the inner angle;

wherein the lengths of the outer wall and the internal barrier wall are such that they overlap and there is no direct line-of-sight from the outer edge to the pedestal.

2. A urinal unit as claimed in claim 1, wherein the base has a series of ridges defining the positions of the side wall, outer wall, and internal barrier wall, and wherein mounting holes are provided on the ridges to receive mounting rods at ends of the outer wall and the internal barrier wall.

3. A urinal unit as claimed in claim 1, wherein the first and second sides of the base comprises cut-outs to receive mounting rods at ends of the first side wall.

4. A urinal unit as claimed in claim 1, wherein the first side wall, the outer wall, and the internal barrier wall are all removably mounted on the base.

5. A urinal unit as claimed in claim 1, wherein the pedestal is removably mounted on the base.

6. A urinal unit as claimed in claim 1, further comprising a sump in the base, wherein the pedestal drains into the sump, and wherein the sump has an access drain located at the outer edge of the base.

7. A urinal unit as claimed in claim 1, wherein a series of steps is defined in the base extending from the outer edge towards the internal barrier wall.

8. A urinal unit as claimed in claim 1, wherein the inner angle is about 60°.

9. A urinal unit as claimed in claim 1, further comprising a second side wall extending along the second side of the base from the apex to the outer edge.

10. A urinal installation, comprising a series of urinal units as claimed in claim 1 arranged so that the first side of one unit is positioned adjacent the second side of another unit.

11. A urinal installation as claimed in claim 10, wherein the units are arranged such that the apex of each unit is centred on a common point.

12. A urinal installation as claimed in claim 11, comprising six units arranged in a circular arrangement.

13. A urinal installation as claimed in claim 10, wherein adjacent urinal units are arranged so that the outer end of the first side of one unit is positioned adjacent the apex end of the second side of the other unit, such that the outer wall of one unit faces in the opposite direction to the outer wall of the adjacent unit.

14. A urinal installation, comprising a series of urinal units as claimed in claim 1, arranged so that the first side of one unit is positioned adjacent the second side of another unit, and the first side wall of the one unit provides a second side wall for the other unit.

15. A urinal installation as claimed in claim 14, wherein the units are arranged such that the apex of each unit is centred on a common point.

16. A urinal installation as claimed in claim 15, comprising six units arranged in a circular arrangement.

17. A urinal installation as claimed in claim 14, wherein adjacent urinal units are arranged so that the outer end of the first side wall of one unit is positioned adjacent the apex end of the second side of the other unit, such that the outer wall of one unit faces in the opposite direction to the outer wall of the adjacent unit.

18. A urinal unit, comprising:

a wedge-shaped base having an inner angle, sides, and an outer edge;

a side wall extending along each side of the base from the inner angle to the outer edge;

an outer wall extending from the outer end of each side wall part-way along the outer edge of the base toward the other side wall so that a space is formed between adjacent ends of the outer walls;

an internal wall extending from the inner angle between the side walls part-way to the outer edge;

an internal barrier wall located at the outer end of the inner wall so as to extend perpendicularly to the internal wall part way towards the side walls; and a urinal pedestal located between each side wall and the internal wall and positioned so that a user faces the outer edge;

wherein the lengths of the outer walls and the internal wall are such that there is no direct line-of-sight through the space between the outer walls to the pedestals.

19. A urinal unit as claimed in claim 18, wherein the base has a series of ridges defining the positions of the side walls, outer walls, internal wall, and barrier wall, and wherein mounting holes are provided on the ridges to receive mounting rods at the ends of the respective side walls, outer walls, internal wall, and barrier wall.

20. A urinal unit as claimed in claim 19, wherein the mounting rods comprise elongate rods with axial slots into which edges of wall structures are inserted.

21. A urinal unit as claimed in claim 18, wherein the side walls, outer walls, internal wall, and barrier wall are all removably mounted on the base.

22. A urinal unit as claimed in claim 18, wherein the pedestals are removably mounted on the base.

23. A urinal unit as claimed in claim 18, further comprising a sump in the base, wherein each pedestal drains into the sump, and wherein the sump has an access drain located at the outer edge of the base.

24. A urinal unit as claimed in claim 18, wherein a series of steps are defined in the base in the space between the ends of the outer walls.

25. A urinal unit as claimed in claim 18, wherein the inner angle is about 120°.

26. A urinal installation, comprising a series of urinal units as claimed in claim 18 arranged so that the side wall of one unit is positioned adjacent the side wall of another unit.

27. A urinal installation as claimed in claim 26, wherein the units are arranged such that the inner angles are centred on a common point.

28. A urinal installation as claimed in claim 27, comprising three units arranged in a circular arrangement.

29. A urinal installation as claimed in claim 26, wherein adjacent urinal units are arranged so that the inner end and outer end of the side wall of one unit are positioned adjacent the outer end and the inner end respectively of the side wall of the other unit, such that the space between the outer walls of one unit faces in the opposite direction to the space between the outer walls of the adjacent unit.

* * * * *